US006968839B2

(12) United States Patent
Lee

(10) Patent No.: US 6,968,839 B2
(45) Date of Patent: Nov. 29, 2005

(54) MULTI-TRAY FIREPLACE TRAY SYSTEM

(76) Inventor: James F. Lee, 42-06 220th St., Bayside, NY (US) 11361

( * ) Notice: Subject to any disclaimer, the term of this patent is extended or adjusted under 35 U.S.C. 154(b) by 51 days.

(21) Appl. No.: 10/383,355

(22) Filed: Mar. 7, 2003

(65) Prior Publication Data

US 2004/0173208 A1 Sep. 9, 2004

(51) Int. Cl.[7] ..... F24B 1/193
(52) U.S. Cl. ..... 126/543
(58) Field of Search ..... 126/543, 243, 126/555

(56) References Cited

U.S. PATENT DOCUMENTS

| | | | | |
|---|---|---|---|---|
| 312,331 | A | 2/1885 | Cissel | |
| D26,686 | S | 2/1897 | Conner | |
| 834,630 | A | 10/1906 | Myers | |
| 950,964 | A | 3/1910 | Singelyn | |
| 1,627,023 | A | 5/1927 | Farrar | |
| 2,050,907 | A | 8/1936 | Wiggers | |
| 2,377,665 | A * | 6/1945 | Best | 126/243 |
| 2,446,669 | A | 8/1948 | Satchik | |
| 2,858,028 | A * | 10/1958 | Hunting et al. | 211/126.12 |
| 4,094,431 | A * | 6/1978 | Wheeler | 220/23.4 |
| 4,240,222 | A * | 12/1980 | Covington | 43/57.1 |
| 4,466,419 | A * | 8/1984 | Syme | 126/4 |
| 4,706,648 | A | 11/1987 | Blount et al. | |
| 4,720,021 | A * | 1/1988 | Byrns | 220/764 |
| 4,742,952 | A * | 5/1988 | Bixler et al. | 229/125.36 |
| 5,010,874 | A | 4/1991 | Toth | |
| 5,067,476 | A | 11/1991 | Rhodes, Jr. | |
| 5,433,929 | A * | 7/1995 | Riihimaki et al. | 422/297 |
| 5,464,103 | A * | 11/1995 | O'Brien | 211/133.3 |
| D382,956 | S | 8/1997 | Collins | |
| D416,620 | S | 11/1999 | Plociak | |
| 6,006,744 | A | 12/1999 | Taylor | |

* cited by examiner

*Primary Examiner*—Stephen Gravini
(74) *Attorney, Agent, or Firm*—Morgan & Finnegan LLP

(57) ABSTRACT

A multi-tray fireplace tray system has a first tray and second tray. The first tray includes a hook. In use, the first tray and the second tray positioned proximate each other. The hook extends from the first tray into the second tray. Each tray includes a bottom surface and side walls extending from the bottom surface to form a walled surface for the for the collection of ash The hook starts from an upper edge of a side wall of the first tray and extends in a substantially C-shape over an upper edge of a side wall in the second tray. The hook terminates at a free end below the upper edge of the second tray side wall. When the first tray is moved, the hook moves the second tray in concert.

20 Claims, 5 Drawing Sheets

MULTI-TRAY FIREPLACE TRAY SYSTEM

CROSS REFERENCE TO RELATED APPLICATIONS

This application is related to U.S. patent application Ser. No. 10/383,425, entitled TWO TIER FIREPLACE GRATE, filed Mar. 7, 2003, by the applicant herein. The related patent application is herein incorporated into this disclosure by reference.

FIELD OF THE INVENTION

The present invention generally relates to a fireplace tray. More particularly, the invention relates to a multi-tray fireplace tray system for insertion into a fireplace below a fireplace grate to receive ash from burnt combustibles for later disposal of collected ash.

BACKGROUND OF THE INVENTION

In a home fireplace, a combustible material is typically burnt to generate heat and create ambiance. Accordingly, the fireplace usually is the visual focal point of a room in many homes.

A first type of home fireplace uses as a combustible material a flammable gas delivered through an outlet system. In this type of fireplace, ceramic logs also may be stacked on and/or above the outlet system to focus heat and/or enhance esthetics. In a more traditional home fireplace, combustible logs or other solid combustible materials are placed on a fireplace grate for burning thereon. The fireplace grate typically comprises a plurality of metal bars joined to form a platform above the ground, the platform is supported by legs and used for supporting logs to be burned. Combustible logs (hereinafter logs) include wood logs, gel logs, and other artificial firelogs formed of particulate combustible material, such as sawdust or coal particles, that is combined with a binder material, such as paraffin, and formed into a desired shape. Positioning the logs above the floor of the fireplace enhances airflow around the logs and thus, enhances combustion of the logs. Ceramic logs may also be used in conjunction with combustible logs.

As logs in a fireplace burn their combustible material, ash is generated. The ash accumulates under the fireplace grate. Therefore, the fireplace must be cleaned periodically and the ash accumulated therein removed to maintain a healthy and esthetically pleasing environment in the home.

Unfortunately, cleaning accumulated ash in a fireplace is laborious. Should ash fall directly on the floor of the fireplace, the cleaning task is both time-consuming and dirty. Typically, removing ash from the fireplace floor involves sweeping the ash into a pile with a broom and using a shovel to move piles of accumulated ash into a trash bag, box, or the like for disposal. However, the person cleaning the fireplace must access the area under the fireplace grate.

Often, the fireplace grate must be moved to obtain access to and to clean the area under the fireplace grate. Fireplace grates are typically constructed of heavy steel bars and thus, are difficult to lift. Due to the cave-like design of fireplaces and positioning of the fireplace grate therein, a person cleaning a fireplace is placed an awkward position when lifting the fireplace grate. The cleaning person can not stand directly over the fireplace grate to be lifted so as to be able to use proper lifting techniques (i.e., lift using both arms and legs). Disadvantageously, the cleaning person must extend his arms into the fireplace to first reach the grate and then lift the grate with extended arms. Accordingly, the cleaning person risks straining his back during lifting. This injury risk rises with the decreased strength and fitness or increased age of the cleaning person.

Alternatively, the fireplace grate may be left in place and fireplace cleaning tools used to clean around the grate. However, fireplace cleaning tools are typically specialized and small-sized to permit maneuvering below and between the metal bars forming the fireplace grate. Purchase of these specialized cleaning tools increases the cost of owning and operating a fireplace in a safe and efficient manner. Further, use of these tools may require the cleaning person to place portions of his body inside the fireplace to reach all areas requiring cleaning. This requirement, while requiring a certain level of fitness to perform, provides the opportunity for the cleaning person to contact soot stained side-walls of the fireplace. In addition, the described cleaning method involves disturbing the accumulated ash, which then may be unintentionally and unavoidably distributed about the room holding the fireplace.

An alternative fireplace cleaning method involves pre-positioning a fireplace tray on the floor of the fireplace under a fireplace grate prior to burning logs therein. Ash then falls directly onto the fireplace tray, more particularly on a walled surface of the tray. After some period of burning logs and accumulating ash, the fireplace tray is removed from the fireplace and the contents of the tray disposed of appropriately. Prior fireplace trays typically have a single walled surface that covers the available area beneath the fireplace grate platform between the legs of the fireplace grate. The surface area of the fireplace tray may be varied by adjusting the length and/or width of the tray. Nevertheless, the fireplace tray must be constructed of a material strong enough to withstand lifting of the entire tray without bending or breaking, which would cause the accumulated ash to spill onto the floor of the fireplace or the room containing the fireplace.

Human nature being what it is, many people delay performing cleaning tasks due to other more pressing or interesting options. However, once the fireplace tray is loaded with ash, it becomes much more difficult to maneuver the tray from under the fireplace grate and over any fireplace door, door ledge, or other obstacle at the entrance to the fireplace without spillage. That is, if the tray in fact can be maneuvered over the obstacle without moving the fireplace grate in the first place. In addition, many individuals have difficulty lifting the combination of the fireplace tray and accumulated ash due to the weight of the load and the awkward lifting position arising from conventional fireplace design, as noted above.

Further art references disclose sectional ash pans that cover an area of a furnace, stove-box, or ash pit. Each sectional ash pan is removable from the ash pit via lift handles. A cleaning person must reach into the furnace and/or over any obstruction in or near the furnace opening to remove individual sections. The further away from the furnace opening the individual sections are, the further the cleaning person must reach into the furnace. These section ash pans have no mechanical cooperation between individual sections that assists in cooperatively moving the sections within the furnace so that a cleaning person is able to more easily access the individual sections.

Even with the assistance of conventional fireplace tools and trays, cleanup of accumulated ash in a fireplace is laborious, time-consuming, dirty, and presents the possibility of injury. The inability to easily, efficiently, and safely maintain the cleanliness of a fireplace may make homeowners hesitant to use their fireplace to any significant extent. This hesitancy in turn reduces the value of a home fireplace and prevents homeowners from fully realizing the benefits of a fireplace.

SUMMARY OF THE INVENTION

A multi-tray fireplace tray system has a first tray and second tray. The first tray includes a hook. In use, the first tray and the second tray positioned proximate each other. The hook extends from the first tray into the second tray. Each tray includes a bottom surface and side walls extending from the bottom surface to form a walled surface for the for the collection of ash The hook starts from an upper edge of a side wall of the first tray and extends in a substantially C-shape over an upper edge of a side wall in the second tray. The hook terminates at a free end below the upper edge of the second tray side wall. When the first tray is moved, the hook moves the second tray in concert. Thus, a cleaning person is able to clean accumulated ash from a fireplace without removing a heavy fireplace grate or using specialize cleaning tools. The cleaning person is able to lift and dispose the contents the multi-tray fireplace tray on a tray-by-tray basis reducing the load to be lifted. Moreover, removal of a first tray section pulls subsequent tray sections from under the fireplace grate so the cleaning person does not have to reach under or around the stationary grate.

BRIEF DESCRIPTION OF THE DRAWINGS

Further aspects of the instant invention will be more readily appreciated upon review of the detailed description of the embodiments included below when taken in conjunction with the accompanying drawings, of which:

FIG. 4 illustrates an exemplary two-tray fireplace tray system pre-positioned in a fireplace;

FIG. 5 illustrates the cooperation between the first tray of the fireplace tray system and the second tray of the fireplace tray system afforded by the hook linking the first tray and the second tray;

FIG. 6 illustrates removal of the first tray of the fireplace tray system from the fireplace;

FIG. 7 illustrates removal of the second tray of the fireplace tray system from the fireplace;

DETAILED DESCRIPTION OF THE INVENTION

Referring now to FIGS. 1–8, wherein similar components of the invention are numerically referenced in like manner, disclosed are exemplary embodiment of a multi-tray fireplace tray system.

Figure 1:
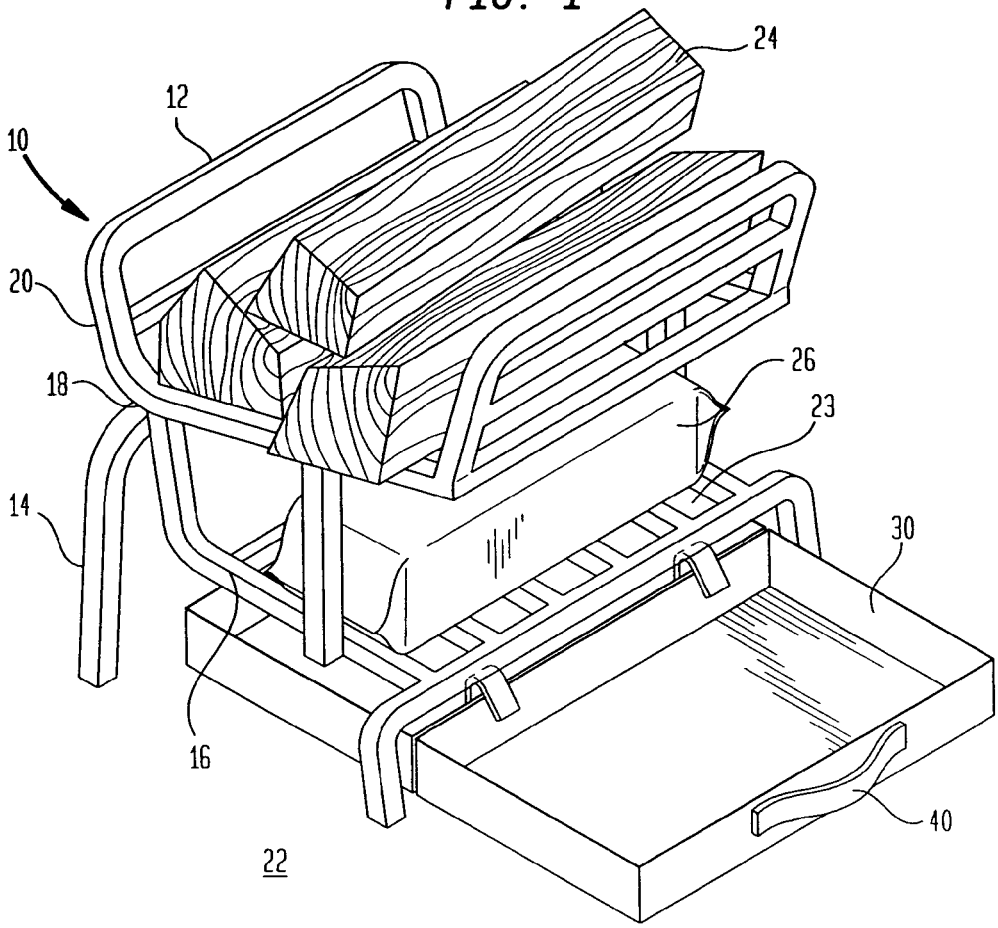
FIG. 1 illustrates the multi-tray fireplace tray system of the invention positioned below a fireplace grate loaded with combustible logs.

FIG. 1 illustrates the multi-tray fireplace tray system of the invention positioned below a fireplace grate loaded with combustible logs. The fireplace grate 10 comprises a plurality of metal bars 12 joined to form legs 14, platforms 16, 18, and side members 20. The legs stabilize the fireplace grate on the ground 22. The platforms provide surfaces raised above the ground for the placement of logs to be burned. The platforms include openings 23 that permit ash to fall below the grate. The side members prevent the logs from falling off the grate during placement and burning. Wood logs 24 are placed on first platform 16. An artificial firelog 26 is placed on second platform 18. The fireplace grate allows the logs to be positioned above the floor of the fireplace, which enhances airflow around the logs. Combustion of the logs is enhanced with increased airflow around the logs.

The artificial firelog 26 is formed of particulate combustible material, such as sawdust or coal particles, that is combined with a binder material, such as paraffin, and formed into a desired shape. The artificial firelog may include a wrapper to assist in ignition of the firelog. As the logs are consumed, ash is generated. The ash falls below the grate 10 through the openings 23 in the grate. Other types of combustible logs including gel logs may be placed on the platforms 16, 18 of the fireplace grate. Various combinations of combustible logs and non-combustible logs, such as ceramic logs, may be placed on either or both platforms of the grate. For instance, ceramic logs could be arranged on the first platform and combustible logs placed on the second platform.

The multi-tray fireplace tray system 30 is positioned under the fireplace grate 10 to collect ash. The multi-tray fireplace tray system covers the available area beneath the fireplace grate between the legs 14 of the fireplace grate. The fireplace tray system collects ash that falls through the openings 23 in the platforms 16, 18 of the fireplace grate 10. The fireplace tray system is constructed of a strong durable material that is able to withstand the heat of a fire. Such construction prevents the trays from bending or breaking during clean-up and spilling accumulated ash onto the floor of the fireplace or the room containing the fireplace. For example, the fireplace trays may be made of pressed steel.

Figure 2:
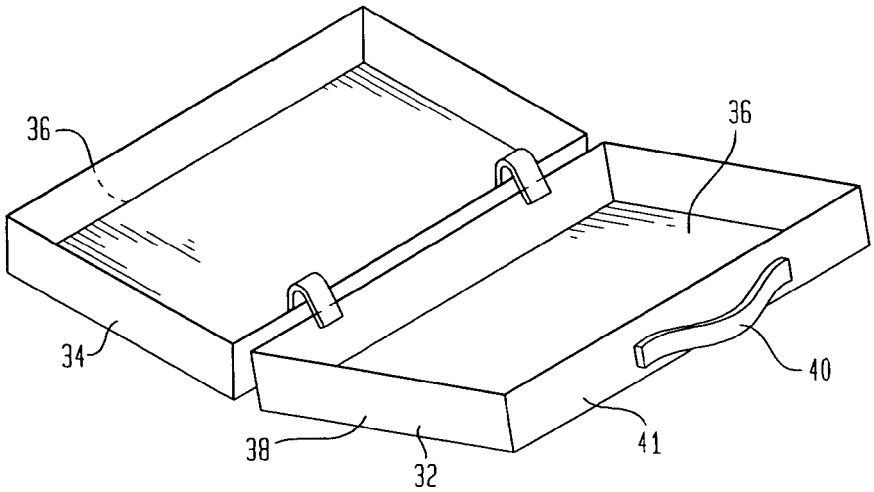
FIG. 2 illustrates an exemplary two-tray fireplace tray system.

FIG. 2 illustrates an exemplary two-tray fireplace tray system. The two-tray fireplace tray system 30 includes a first tray 32 and a second tray 34. In use, the first tray and the second tray are positioned contiguous to each other. Each tray includes a bottom surface 36 and one or more side walls 38. As ash is generated and falls through the openings 23 in fireplace grate 10, the ash accumulates on the bottom surface. The side walls prevent an accumulation of ash from spilling off the bottom surface and out of the tray. The first tray includes a handle 40 on an outer surface 41 of first side wall. The first tray also include one or more hooks 42 on a second side wall. The combination of the handle and the hooks enable a cleaning person to easily pull/move the fireplace tray system. The cleaning person applies a pulling force directly on the handle of the first tray. As the first tray moves, the hooks engage the side wall of the second tray, applying the same directional force on the second tray. Thus, movement of the first tray moves the second tray, the fireplace tray system moving in concert.

Figure 3:
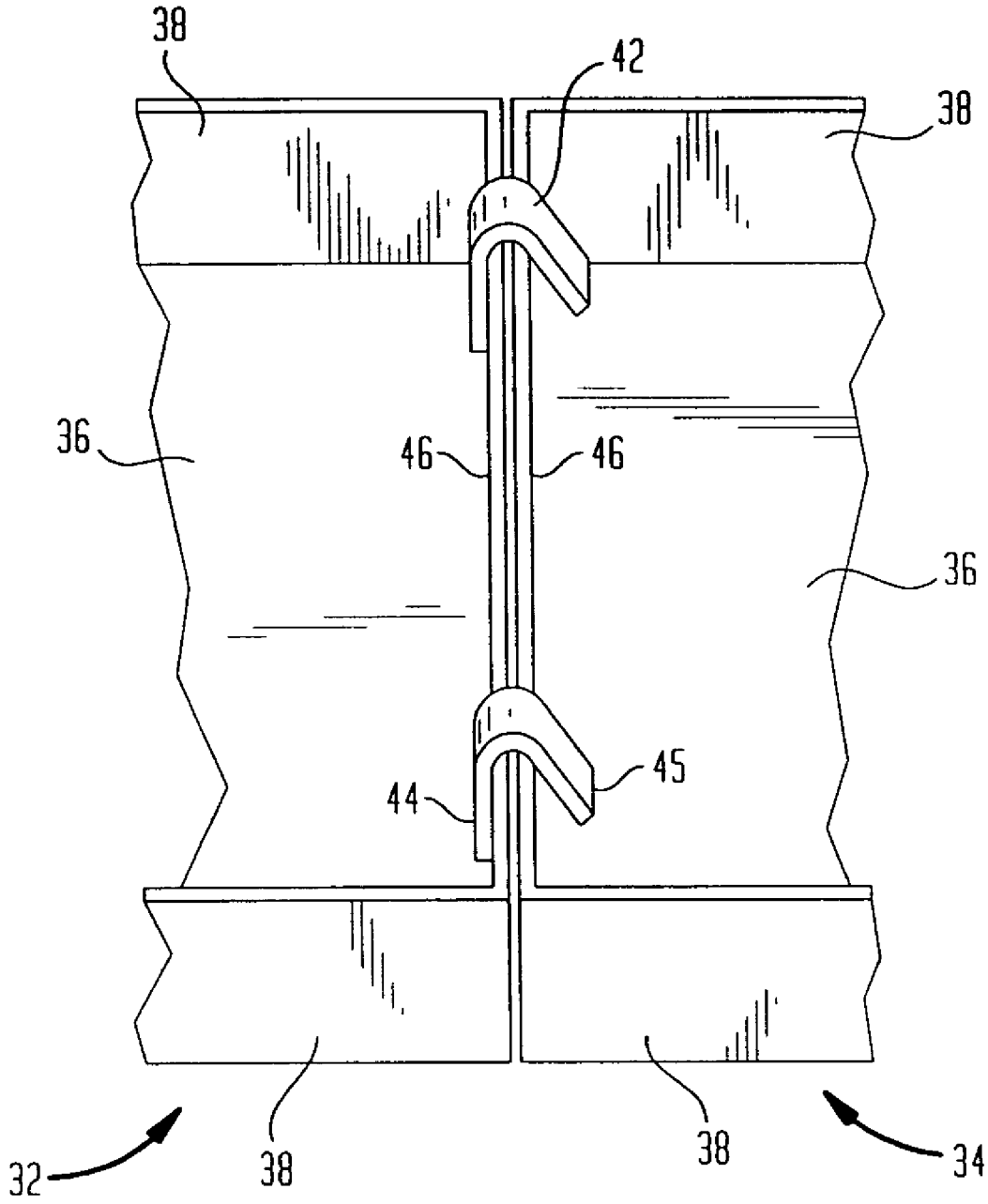
FIG. 3 illustrates additional detail of the circled areas of FIG. 2, and details an exemplary hook cooperatively linking the first tray of the fireplace tray system to the second tray of the fireplace tray system.

FIG. 3 illustrates additional detail of the circled areas of FIG. 2, and details an exemplary hook cooperatively linking the first tray of the fireplace tray system to the second tray of the fireplace tray system. Hook 42 extends from an attached end 44 proximate the upper edge 46 of a side wall 38 of the first tray to a position above the upper edge, thus extending in a direction substantially perpendicular to the bottom surface of the first tray. The hook then spans a predetermined distance substantially parallel to the bottom surface 36 before extending further substantially perpendicular to the bottom surface and ending at a free end 45 at a level below the upper edge of the side wall. In this preferred embodiment, the hooks have a substantially C-shape although other shaped hooks with less or more directional changes are within the contemplated scope of the invention.

In operation, the first tray 32 and second tray 34 are placed adjacent to each other. The first tray's side wall that carries the hook 42 is positioned adjacent to a side wall of the second tray. The hook extends into the second tray, the free end 44 of the hook extending below the upper edge 46 of the second tray. The hook engages side wall 38 of the second tray when the first tray is moved. Therefore, when a directional force is applied to the fireplace tray system, the first tray and the second tray move in concert.

Figure 4:
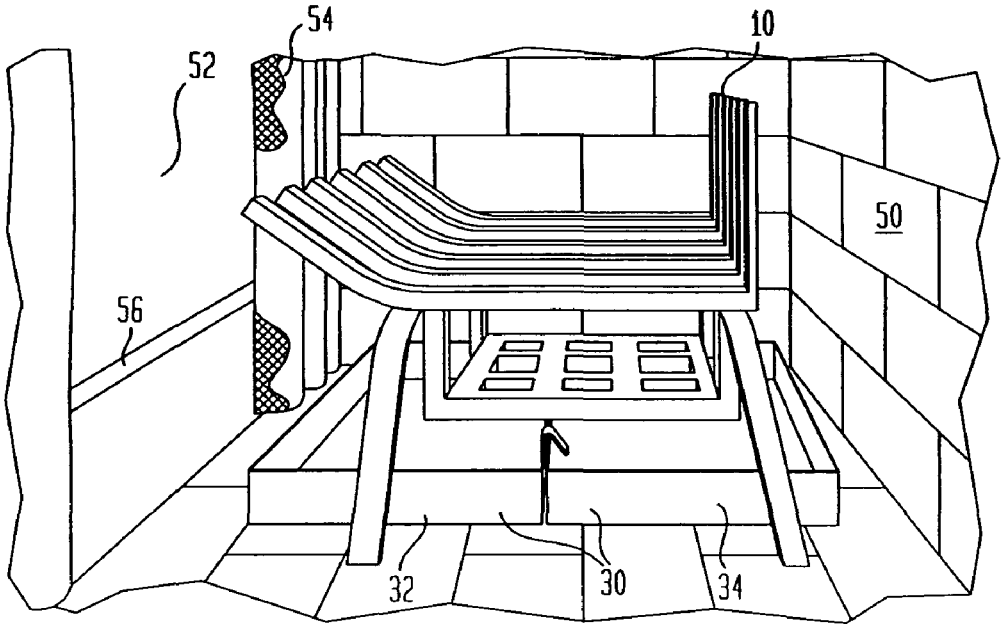
FIGS. 4–7 illustrate an exemplary use of the multi-tray fireplace tray system of the invention.

FIGS. 4–7 illustrate use of the multi-tray fireplace tray system of the invention. FIG. 4 illustrates the exemplary two-tray fireplace tray system pre-positioned in a fireplace. Fireplace 50 includes an opening 52 for entry into the fireplace. The opening has a door 54 with a door ledge 56. Fireplace grate 10 is positioned in fireplace 50. The two-tray fireplace tray system 30, which includes a first tray 32 and a second tray 34, is positioned under the fireplace grate.

Figure 5:
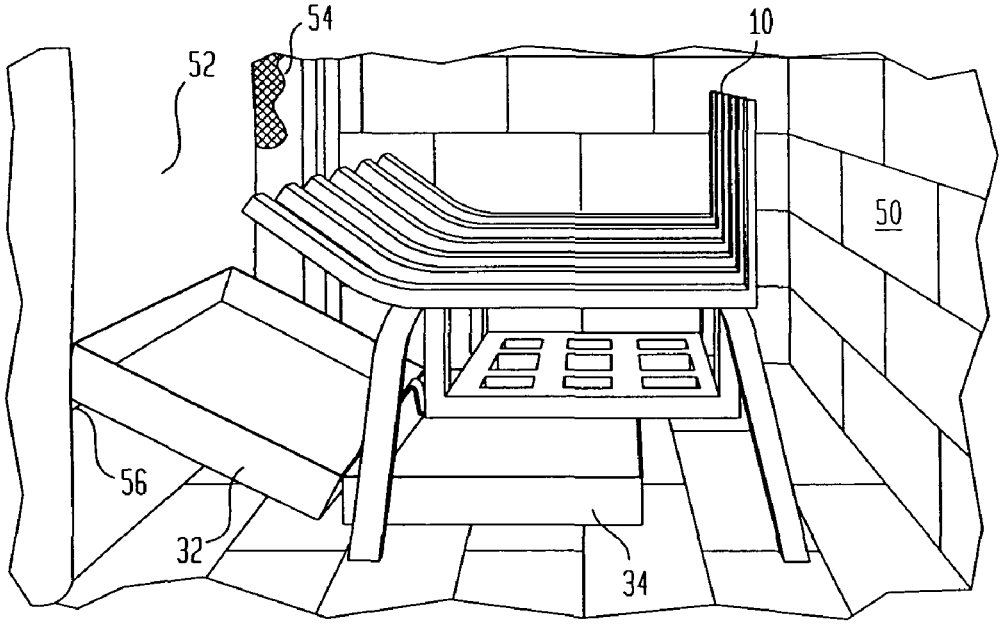

FIG. 5 illustrates the cooperation between the first tray of the fireplace tray system and the second tray of the fireplace tray system afforded by the hook linking the first tray and the second tray. As is apparent from the illustration, would a single fireplace tray cover the entire area under the fireplace grate, the single tray could not be removed from the fireplace without first removing the grate. The fireplace tray could not be pulled directly on the ground from the fireplace due to the door ledge 56 of the door 54. Further, the structure of the fireplace grate would prevent the tray from being angled enough to be pulled over the door ledge 56. The same is true should the fireplace grate be a conventional single platform grate or the two platform grate depicted.

Also, compared to a conventional single platform fireplace grate, additional structural members are required to form a two platform grate, making the two platform grate heavier to lift/move. The multi-tray fireplace tray system permits easy and safe clean-up of the fireplace without lifting/moving of the heavy fireplace grate. As the handle 40 of the first tray 32 is pulled, the second tray 34 follows the first tray. The handle also allow the first tray to be cocked at an angle for removal over the door ledge.

Figure 6:
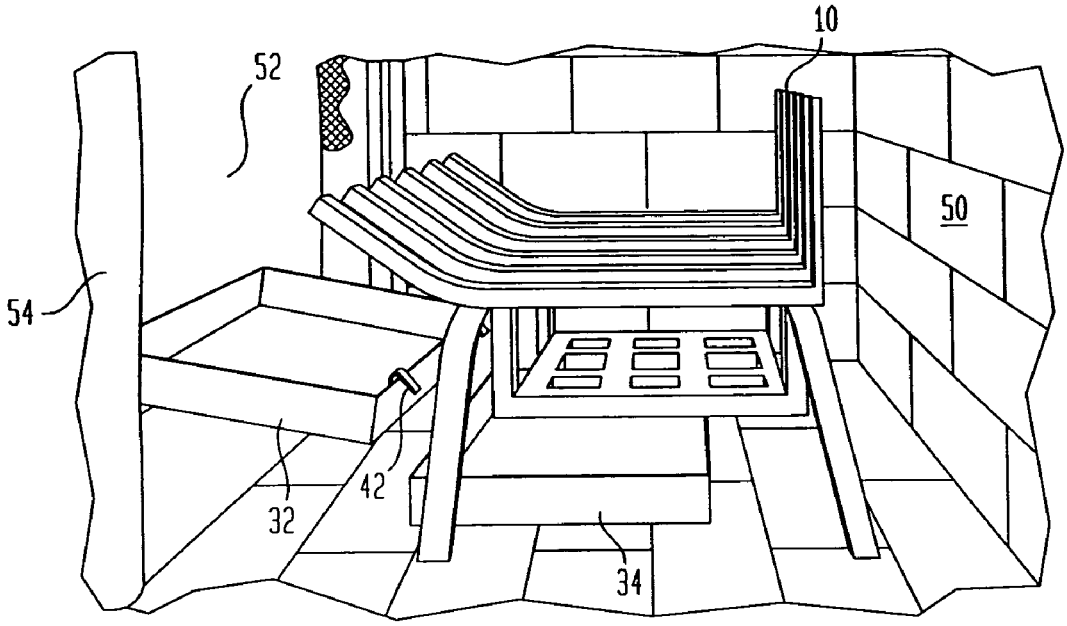

FIG. 6 illustrates removal of the first tray of the fireplace tray system from the fireplace. The first tray is lifted. Upon lifting the first tray, the hooks of the first tray no longer contact/engage the side wall of the second tray. The first tray unhooks from the second tray and is easily removed from the fireplace for disposal of its contents. At the same time, the second tray is left within easy reach of the opening of the fireplace.

Figure 7:
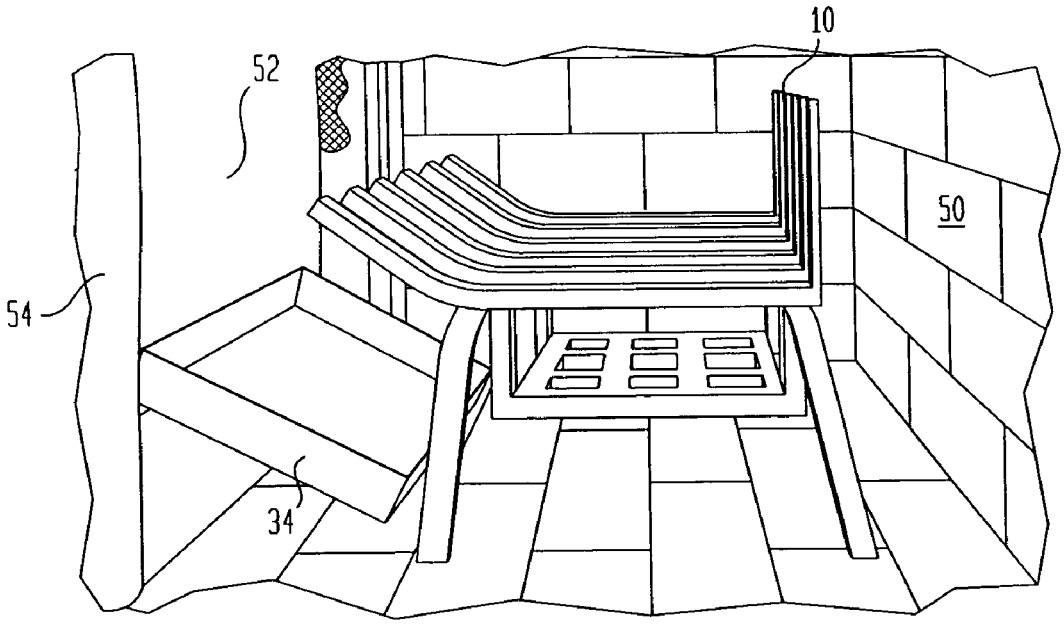

FIG. 7 illustrates removal of the second tray of the fireplace tray system from the fireplace. The second tray is removed in the same manner as the first tray. The second tray is angled and lifted over the door ledge. The contents of the second tray are then disposed of appropriately.

The fireplace tray system may include more than two trays. In such an embodiment, the second and subsequent trays, except for a last tray, include hooks as described above. The hooks serve to pull each subsequent tray. In addition, while rectangular shaped trays with four side walls are illustrated, trays may be formed with two or more planar or curved side walls to create wall surfaces for collecting ash. For example, each tray may be semi-circular with a hook linking the trays at the center of a circle formed by their contiguous placement.

To place the multi-tray fireplace tray system under the fireplace grate, the process illustrated in FIGS. 4–7 is reversed. The second tray is lifted over the door ledge, placed in the fireplace floor and pushed partially under the fireplace grate. The first tray is then lifted over the door ledge and angled into the fireplace until its side wall having hooks abuts a side wall of the second tray. The hooks carry over and extend below the side wall upper edge of the second tray. The first tray is then pushed into the fireplace and under the fireplace grate, pushing the second tray further under the fireplace grate and installing the multi-tray fireplace tray system under the grate.

Figure 8:
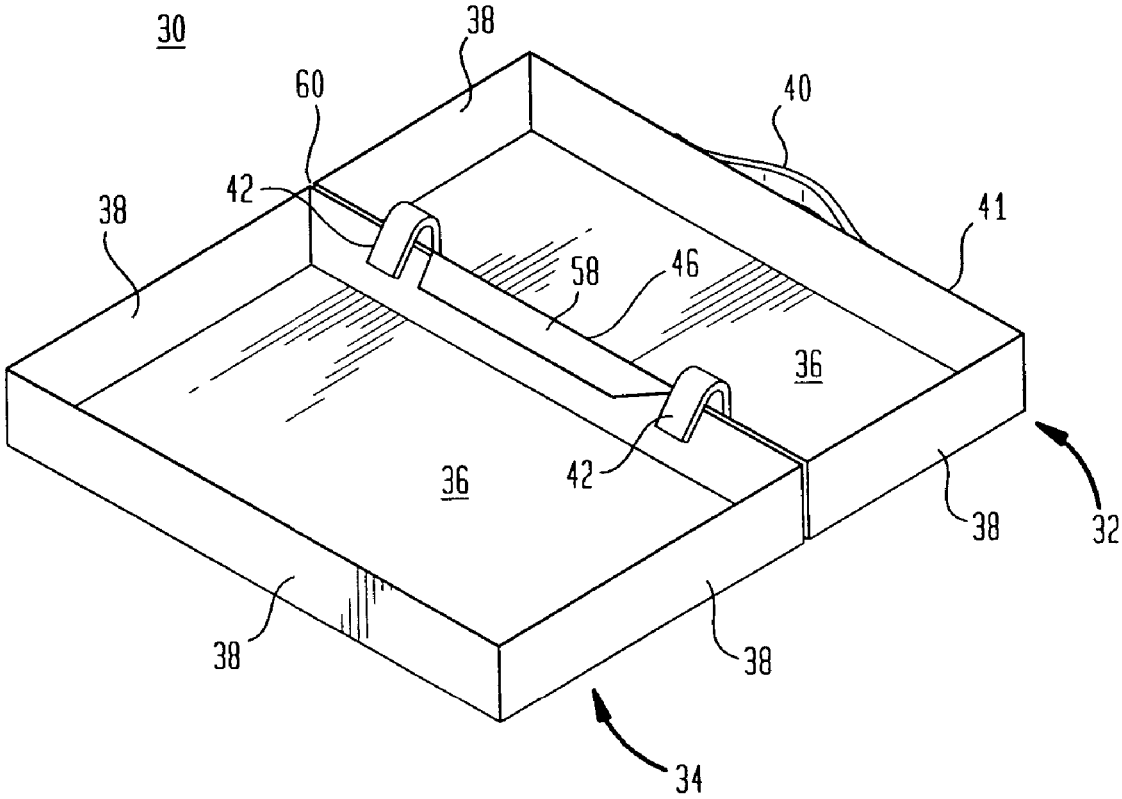
FIG. 8 illustrates an alternative two piece fireplace tray system implementing the invention.

FIG. 8 illustrates an alternative two piece fireplace tray system implementing the invention. The two tray fireplace tray system illustrated therein is similar to that show in the prior figures with the addition of a flange 58 that extends from the upper edge 46 of the side wall 38 of the first tray 32 to a position above the upper edge of the side wall the second tray 34. The flange spans the joint 60 between the first tray and the second tray, preventing ash from falling directly between the first and second tray. By using a flange to collect ash, trays may be formed with one or more planar or curved side walls to created wall surfaces. Ash that does not fall on the bottom surface of the trays falls on the flanged areas between trays.

Additional embodiments contemplated enable the surface area of the fireplace tray system to be varied by adjusting the length and/or width of the individual trays. In such embodiments, each side wall is formed by sections that slide tongue and groove with each other. The bottom surface in those embodiments is formed by bottom sections that move relative to and over each other to form a single bottom surface.

It is the intent of the invention to provide a multi-tray fireplace tray system that enables fireplace users to easily, efficiently, and safely maintain the cleanliness of their fireplace. FIGS. 1–8 describe a multi-tray fireplace tray system that facilitates the collection and removal of ash generated by the combustion of combustible materials in a fireplace. By a better system for ash collection and removal, a home owner is more apt to utilize their fireplace, thereby realizing the full benefit of ownership of a home with a fireplace.

It should be understood that, for convenience, the above description is representative of embodiments according to the principles of the invention without exhaustively enumerating all possible embodiments. Other embodiments may result from combination of alternative embodiments described herein and, as will be appreciated, are within the scope of the following claims. The figures described herein are for illustrative purposes only, it being possible to implement the invention with embodiments that differ considerably in appearance from the ones depicted here, while at the same time falling within the spirit of the invention.

What is claimed is:

1. A multi-tray fireplace tray system comprising:

a first fireplace tray; and a second fireplace tray, each fireplace tray having a substantially flat bottom surface, the first fireplace tray including a hook adapted to non-fixedly attach the second fireplace tray, wherein the hook is adapted to extend from the first fireplace tray into the second fireplace tray when the first fireplace tray and the second fireplace tray are positioned proximate each other.

2. The multi-tray fireplace tray system of claim 1 wherein each fireplace tray further comprises:

at least one side wall extending from the substantially flat bottom surface, the side wall having an upper edge.

3. The multi-tray fireplace tray system of claim 2 wherein the hook includes an attached end and a free end, the attached end extending from proximate the upper edge of the side wall to above the upper edge in a direction substantially perpendicular to the substantially flat bottom surface, the hook further extending substantially parallel to the substantially flat bottom surface, the hook further extending substantially perpendicular to the substantially flat bottom surface to below the upper edge of the side wall and ending at the free end.

4. The multi-tray fireplace tray system of claim 2 wherein the hook extends from a first portion of the upper edge; and further including a flange that extends from a second portion of the upper edge.

5. The multi-tray fireplace tray system of claim 1 wherein the hook is substantially C-shaped.

6. The multi-tray fireplace tray system of claim 1 wherein each fireplace tray further comprises:

four side walls extending from the substantially flat bottom surface, each side wall having an upper edge.

7. The multi-tray fireplace tray system of claim 6 wherein at least one side wall is adjustable and comprises two side sections joined tongue in groove, and wherein the substantially flat bottom surface is formed by overlapping substantially flat bottom sections.

8. The multi-tray fireplace tray system of claim 1 further comprising:

a handle attached to the first fireplace tray.

9. The multi-tray fireplace tray system of claim 1 further comprising:

a third fireplace tray, the second fireplace tray further including a second hook adapted to non-fixedly attach the third fireplace tray, wherein the second hook is adapted to extend from second fireplace tray into the third fireplace tray when the second fireplace tray and the third fireplace tray are positioned proximate each other.

10. A multi-tray fireplace tray system comprising:

a first fireplace tray having a first substantially flat bottom surface, a first side wall extending from the first substantially flat bottom surface, the first side wall having a first upper edge, and a hook extending from the first side wall; and a second fireplace tray having a second substantially flat bottom surface, and a second side wall extending from the second substantially flat bottom surface, the second side wall having an upper edge;

the hook adapted to non-fixedly attach the second side wall, wherein the hook is adapted to extend from the first fireplace tray into the second fireplace tray and below the second upper edge of the second fireplace tray when the first fireplace tray is positioned proximate the second fireplace tray.

11. The multi-tray fireplace tray system of claim 10 wherein the hook is substantially C-shaped.

12. The multi-tray fireplace tray system of claim 10 wherein the hook includes a free end, the hook extending substantially perpendicular to the first substantially flat bottom surface from proximate the first upper edge of the first side wall to above the first upper edge, the hook further extending substantially parallel to the first substantially flat bottom surface and then further extending substantially perpendicular to the first substantially flat bottom surface to terminate below the first upper edge of the first side wall at the free end.

13. The multi-tray fireplace tray system of claim 10 wherein the hook extends from a first portion of the first upper edge; and further including a flange that extends from a second portion of the first upper edge.

14. The multi-tray fireplace tray system of claim 10 wherein the second fireplace tray further includes a second hook and further comprising:

a third fireplace tray having a third substantially flat bottom surface, and a third side wall extending from the third substantially flat bottom surface, the third side wall having a third upper edge;

the second hook adapted to non-fixedly attach the third side wall, wherein the second hook is adapted to extend from the second fireplace tray into the third fireplace tray and below the third upper edge of the third fireplace tray when the third fireplace tray is positioned proximate the second fireplace tray.

15. A multi-tray fireplace tray system comprising:

a first walled fireplace compartment with a first substantially horizontally planar bottom surface; and a second walled fireplace compartment with a second substantially horizontally planar bottom surface, the second walled compartment including a substantially C-shaped hook adapted to extend into and non-fixedly attach the first walled fireplace compartment when the second walled fireplace compartment is positioned proximate the first walled fireplace compartment.

16. The multi-tray fireplace tray system of claim 15 wherein the second walled fireplace compartment includes a projection for covering the gap between the first walled fireplace compartment and the second walled fireplace compartment.

17. The multi-tray fireplace tray system of claim 1 wherein the material of which the first fireplace tray and the second fireplace tray are formed is a substantially heat-resistant material.

18. The multi-tray fireplace tray system of claim 1 wherein the material of which the first fireplace tray and the second fireplace tray are formed is pressed steel.

19. The multi-tray fireplace tray system of claim 10 wherein the material of which the first fireplace tray and the second fireplace tray are formed is a substantially heat-resistant material.

20. The multi-tray fireplace tray system of claim 15 wherein the material of which the first walled fireplace compartment and the second walled fireplace compartment are formed is a substantially heat-resistant material.

* * * * *